US005189333A

United States Patent [19]

Kagawa et al.

[11] Patent Number: 5,189,333

[45] Date of Patent: Feb. 23, 1993

[54] MULTI-GAP SPARK PLUG FOR AN INTERNAL COMBUSTION ENGINE

[75] Inventors: Junichi Kagawa; Masaaki Murase; Shinichi Nakamura, all of Nagoya, Japan

[73] Assignee: NGK Spark Plug Co., Ltd., Nagoya, Japan

[21] Appl. No.: 661,149

[22] Filed: Feb. 27, 1991

[30] Foreign Application Priority Data

Aug. 8, 1990 [JP] Japan ..... 2-211085

[51] Int. Cl.[5] ..... H01T 13/46; H01T 13/32

[52] U.S. Cl. ..... 313/140; 313/143

[58] Field of Search ..... 313/140, 143

[56] References Cited

U.S. PATENT DOCUMENTS

| | | | |
|---|---|---|---|
| 1,270,521 | 6/1918 | Hill | 313/140 X |
| 2,252,636 | 8/1941 | Kohout et al. | 313/140 X |
| 4,211,952 | 7/1980 | Iwata et al. | 313/143 |
| 4,931,686 | 6/1990 | Oakley | 313/143 X |

FOREIGN PATENT DOCUMENTS 51-95540 8/1976 Japan .

53-95443 8/1978 Japan .

*Primary Examiner*—Palmer C. DeMeo

*Attorney, Agent, or Firm*—Sughrue, Mion, Zinn, Macpeak & Seas

[57] ABSTRACT

In a multi-gap type spark plug for an internal combustion engine, the spark plug has a cylindrical metallic shell into which a tubular ceramic insulator is enclosed. The insulator has a tapered front leg portion, a front end of which extends beyond that of the metallic shell. A center electrode is enclosed into the insulator, having at a front end thereof, a filing tip extending beyond that of the insulator. A plurality of L-shaped outer electrodes each having a vertical piece and lateral piece, the vertical piece depending from the front end of the metallic shell to surround the front end of the insulator, while the lateral piece having an inner surface arranged in parallel with a front end surface of the insulator, and having an end tip terminated to oppose an outer surface of the firing tip through a spark gap established therebetween. A vertical distance between the front end surface of the insulator and the inner surface of the lateral piece of each outer electrode is determined to be within a dimension ranging from 0.3 mm to 1.2 mm.

2 Claims, 5 Drawing Sheets

MULTI-GAP SPARK PLUG FOR AN INTERNAL COMBUSTION ENGINE

BACKGROUND OF THE INVENTION

1. Field of the Invention

This invention relates to a multi-gap type spark plug in which a plurality of outer electrodes are arranged opposed to a center electrode, and particularly concerns a multi-gap type spark plug directed to an improvement of a gap relationship among the electrodes.

2. Description of Prior Art

In a multi-gap type spark plug in which an insulator and a center electrode are in turn enclosed into a metallic shell, three outer electrodes are provided in opposition to a center electrode as shown in Japanese Patent Provisional Publication Nos. 51-95540 and 53-95443. In the former reference a main gap is dimensionally determined to be less than a summation of a secondary gap and a surface creeping gap so as to improve an ignition against a lean fuel gas mixture. In the latter reference, a first spark gap is dimensionally determined to be greater than a second spark gap, so that a voltage needed to discharge at the first spark gap is greater than that of the second spark gap.

Both the references, are directed to an ignition performance which tends to be inferior in comparison to a single gap-type spark plug because the outer electrodes decrease the chances of allowing the fuel gas mixture to pass through the spark gap when the fuel gas mixture is introduced into an engine cylinder.

In order to improve the ignition performance from, it has been resorted to adjusting a length dimension in which a front end of a leg portion of the insulator extends beyond that of the metallic shell. The leg portion of the insulator is a lower half portion which is tapered toward a front end thereof. It has been required to shorten the leg portion by 0.5 mm to 2.0 mm so as to ensure a heat-resistant property comparable to that of an ordinary spark plug which has a L-shaped outer electrode can achieve.

As the front end of the insulator extends beyond that of the metallic shell, a distance between the front end of the insulator and the outer electrode is shortened so as to cause semi-creeping discharge or channeling although the extended front end of the insulator is effectively cooled by the intake fuel gas mixture.

On the other hand, as an entire length of the leg portion is shortened to dimensionally decrease the front end which the leg portion extends beyond the metallic shell, a discharge spark between the electrodes decreases chances to run along a fouled surface of the front end of the insulator so as to hinder self-cleaning action although decreased heat capacity of the leg portion improves its heat dissipation.

Nowadays, it is common to dimensionally decrease the front end which the leg portion extends beyond the metallic shell with the self-cleaning action somewhat sacrificed, so that the front end of the leg portion is vulnerable to fouling due to a deposit of carbon particles produced when the fuel gas mixture is burned at the time of an ignition.

Therefore, it is an object of the invention to eliminate the above drawbacks on the basis that a minimum distance between the outer electrode and a front surface end of the insulator is found not to be so strictly necessary. The invention provides a multi-gap type spark plug which enables lengthening the front end of the leg portion without diminishing the leg portion to favorably dissipate heat from the leg portion, and at the same time achieving an improved self-cleaning action so as to protect the front end of the leg portion against fouling.

SUMMARY OF THE INVENTION

According to the present invention, there is provided a multi-gap type spark plug comprising; a cylindrical metallic shell into which a tubular ceramic insulator is concentrically enclosed, the insulator having a tapered front leg portion, a front end of which somewhat extends beyond that of the metallic shell; a center electrode concentrically enclosed into the insulator, a front end of the center electrode extending beyond that of the insulator to work as a firing tip; a plurality of L-shaped outer electrodes each having a vertical piece and lateral piece, the vertical piece depending from the front end of the metallic shell to circumferentially surround the front end of the insulator, while the lateral piece having an inner surface arranged in parallel with a front end surface of the insulator, and having an end tip terminated to oppose to an outer surface of the firing tip through a spark gap established therebetween; and a vertical distance between the front end surface of the insulator and the inner surface of the lateral piece of each outer electrode being determined to be within a dimension ranging from 0.3 mm to 1.2 mm both inclusive.

The lengthened front end of the insulator makes it possible to enlarge its outer surface area to improve a heat-resistant property because the lengthened front end is effectively cooled each time when an intake fuel gas mixture is introduced into an engine cylinder. This substantially eliminates a necessity of decreasing the length of the leg portion. Otherwise, it is sufficient only to slightly decreasing the length of the leg portion if any. Further, when the fouling decreases an insulating resistance between the electrodes, a spark discharge occurs to run along the front end surface to remove a particulate cabon deposit so as to effect a self-cleaning action. The vertical distance (b) in less than 0.3 mm often causes semi-creeping discharge and channeling on an outer surface of the insulator, while the vertical distance (b) exceeding to 1.2 mm comes to worsen the cooling and self-cleaning effects.

In a multi-gap type spark plug in which the end tip of the lateral piece of each outer electrode extends beyond a cornered portion of the front end surface of the insulator to partially overlap therewith, a relationship among dimensions (a), (b) and (c) is determined as follows:

$(a/2) \leqq b \leqq (3a/2)$, $(c) > (a)$, where (a): a spark gap between the outer surface of the firing tip and the end tip of the lateral piece of each outer electrode, (b): a vertical distance between the front end surface of the insulator and the inner surface of the lateral piece of each outer electrode, (c): a lateral distance between an outer surface of the front end of the insulator and an inner surface of the vertical piece of each outer electrode.

When the front end surface of the insulator is free from the particulate carbon deposit, a voltage necessary to cause a spark discharge between the front end surface of the insulator and the outer electrode is $\frac{1}{2}$ to $\frac{3}{4}$ times greater than that between the firing tip of the center electrode of the insulator and the end tip of the outer electrode.

Therefore, it is necessary to arrange $(a/2) \leqq (b)$ so as to discharge through the spark gap between the firing tip of the center electrode of the insulator and the end tip of the outer electrode.

When the front end surface of the insulator is fouled, its front end surface becomes equivalent to an electrical conductor to require a theoretical relationship $(b) \leqq (a)$ and $(c) > (a)$. In this instance, taking eccentric errors among the insulator and the electrodes into consideration, the relationship among (a), (b) and (c) are determined to be $(a/2) \leqq b \leqq (3a/2)$ so as to creep the spark discharge between the front end surface of the insulator and the inner side of the lateral piece of the outer electrode for effecting the self-cleaning action.

In a multi-gap type spark plug in which the end tip of the lateral piece of each outer electrode terminates short of a cornered portion of the front end surface of the insulator to partially overlap therewith, a relationship among dimensions (a), (d) and (c) is determined as follows:

$(a/2) \leqq d \leqq (3a/2)$, $(c) > (a)$, where (a): a spark gap between the outer surface of the firing tip and the end tip of the lateral piece of each outer electrode, (d): a minimum distance between the front end surface of the insulator and the inner surface of the lateral piece of each outer electrode, (c): a lateral distance between an outer surface of the front end of the insulator and an inner surface of the vertical piece of each outer electrode.

When the front end surface of the insulator is free from the particulate carbon deposit, a voltage necessary to cause a spark discharge between the front end surface of the insulator and the outer electrode is $\frac{1}{2}$ to $\frac{3}{4}$ times greater than that between the firing tip of the center electrode of the insulator and the end tip of the outer electrode. Therefore, it is necessary to arrange $(a/2) \leqq (d)$ so as to discharge through the spark gap between the firing tip of the center electrode of the insulator and the end tip of the outer electrode.

When the front end surface of the insulator is fouled, its front end surface becomes equivalent to an electrical conductor to require a theoretical relationship $(d) \leqq (a)$ and $(c) > (a)$. In this instance, taking eccentric errors among the insulator and the electrodes into consideration, the relationship among (a), (d) and (c) are determined to be $(a/2) \leqq d \leqq (3a/2)$ so as to run the spark discharge between the front end surface of the insulator and the inner side of the lateral piece of the outer electrode for effecting the self-cleaning action.

Various other objects and advantages to be obtained by the present invention will be appeared in the following description and in the accompanying drawings.

DETAILED DESCRIPTION OF PREFERRED EMBODIMENTS

Figure 1:
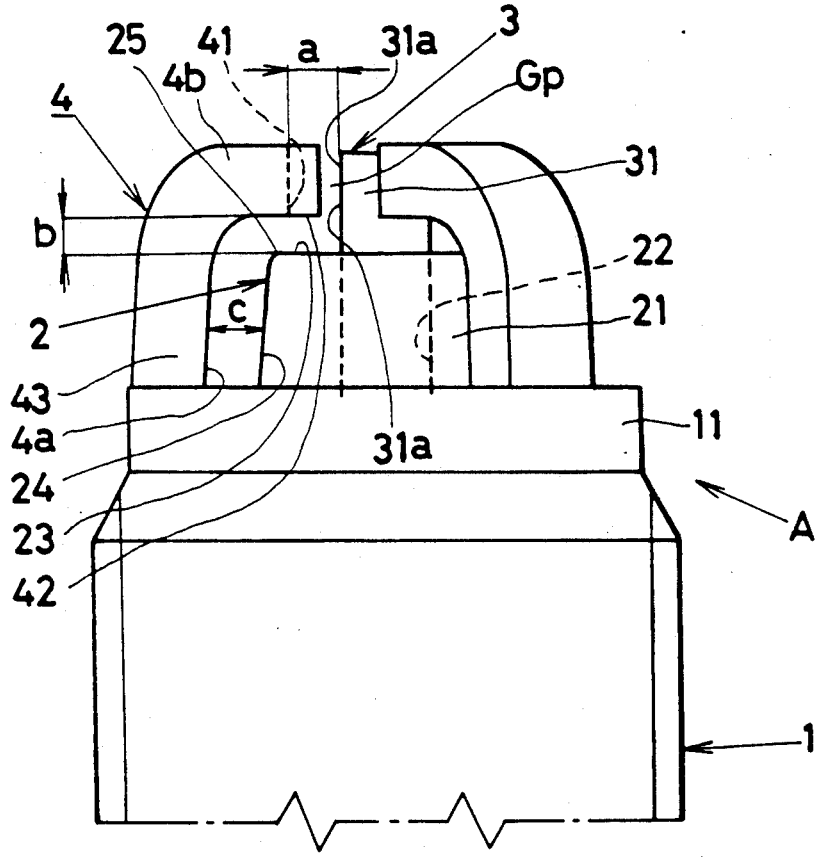
FIG. 1 is an enlarged view of a main part of a multi-gap type spark plug according to a first embodiment of the invention.
Figure 2:
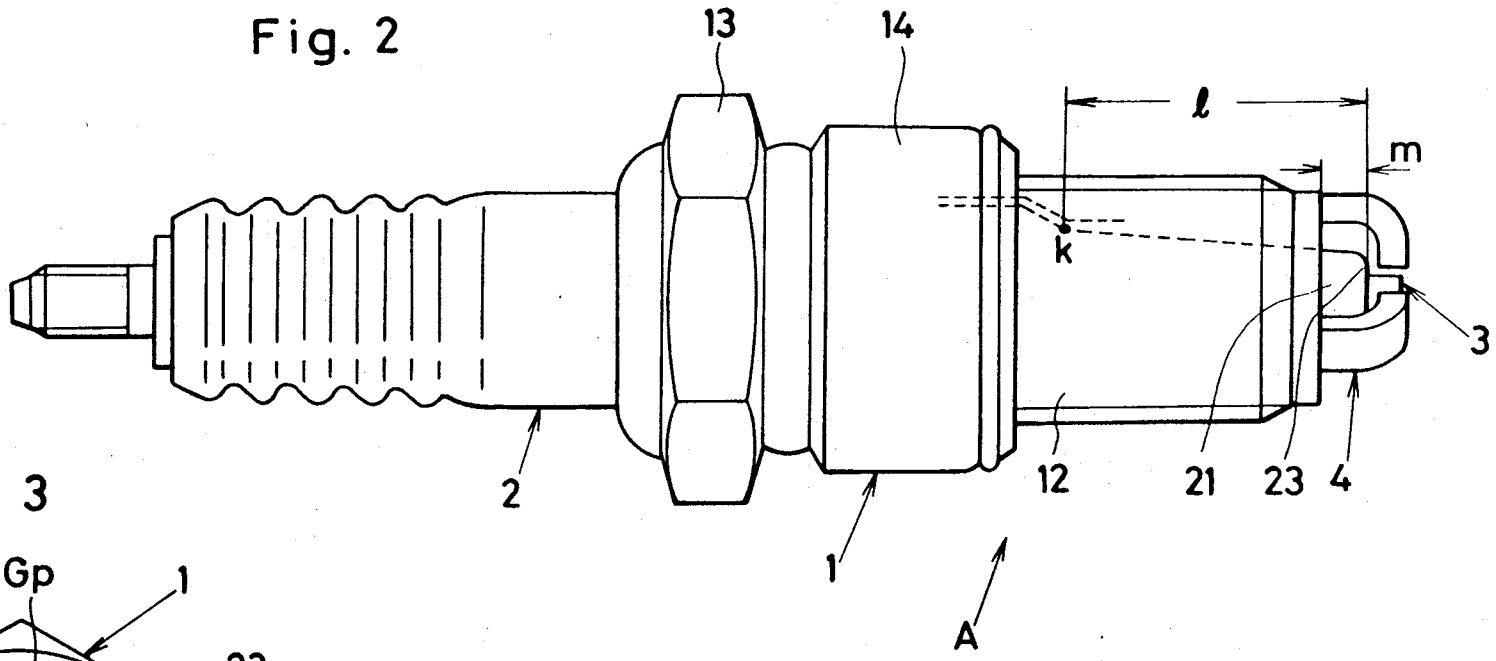
FIG. 2 is an elevational view of a multi-gap type spark plug.
Figure 3:
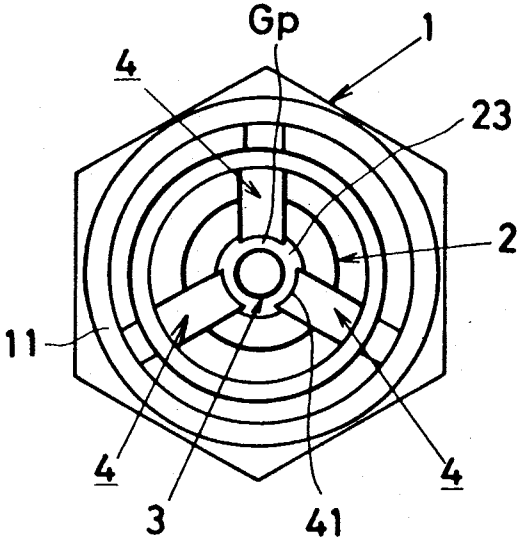
FIG. 3 is a bottom plan view of FIG. 2.

Referring to FIG. 1, there is shown electrodes of a multi-gap type spark plug (A) depicted in FIG. 2 which is incorporated into a cylinder head of an internal combustion engine (not shown) according to a first embodiment of the invention. The spark plug 1 has a cylindrical metallic shell 1 made of a low carbon steel, and comprising a male thread portion 12 (JIS M14×1.25), a hexagonal nut portion 13 and a middle portion 14 which is 19.5 mm in diameter. The hexagonal nut portion 13 works to expedite an installment when the plug (A) is to be secured to the cylinder head by using a tool such as, for example, a wrench. Within the metallic shell 1, a tubular insulator 2 is concentrically placed, an inner space of which serves as an axial bore 22. The insulator 2 is made of a sintered ceramic material with alumina as a main component, and integrally having a tapered leg portion 21 at a lower half portion of the insulator 2 as indicated by a length (l) in FIG. 2 which extends from point (k) to a front end of the insulator 2. The front end of the insulator 2 extends beyond that of the metallic shell 1 by 2.5 mm as indicated at point (m) in FIG. 2, while the leg portion 21 is determined to be 14 mm in length, and a front end surface 23 of the leg portion 21 determined to be 5.1 mm in diameter. Within the axial bore 22 of the insulator 2, a center electrode 3 is concentrically placed which is made of nickel-based alloy, and determined to be 2.5 mm in diameter. A front end of the center electrode 3 extends beyond that of the insulator 2 to work as a firing tip 31. Numeral 4 designates each of three outer electrodes, each of which is dimensionally similar, and made of nickel-based alloy. The outer electrode 4 includes a vertical piece 43 and a lateral piece **4*b* to generally form a L-shape configuration. The vertical piece 43 depends from the front end 11 of the metallic shell 1 to circumferentially surround the front end of the insulator 2 with regular intervals of 120 degrees. The vertical piece 43 of the outer electrode 4 integrally connects the lateral piece 4*b* which has an inner surface 42 arranged in parallel with the front end surface 23 of the insulator 2. An end tip 41 of the lateral piece 4*b* extends beyond a cornered portion 25 of the front end surface 23 toward a center of the insulator 2 so as to partially overlap therewith, and the end tip 41 is located to oppose an outer surface 31*a* of the firing tip 31** through a spark gap (Gp), a dimension of which is determined in detail hereinafter.

As shown in FIG. 1 in which a dimensional relationship is somewhat exaggerated for the purpose of illustration, a vertical distance (b) between the inner surface 42 of the lateral piece **4*b* of the outer electrode 4 and the front end surface 23 of the insulator 2, is determined to be 0.7 mm, for example, which falls within a dimension ranging from 0.3 mm to 1.2 mm both inclusive. A lateral distance (c) between an outer surface 24 of the front end of the insulator 2 and an inner surface 4*a* of the vertical piece 43 of the outer electrode 4, is determined to be 1.5 mm. Further, a minimum distance (a) between the outer surface 31*a* of the firing tip 31 and the end tip 41 of the lateral piece 4*b***, is determined to be 0.8 mm, a width distance of which is equivalent to that of the spark gap (Gp).

In this instance, the vertical distance (b) is determined to be 0.7 mm in order to fall within a dimension ranging from 0.3 mm to 1.2 mm both inclusive. The dimensional relationship among the distances (a), (b) and (c) is arranged to satisfy expressions $(a/2) \leqq (b) \leqq (3a/2)$ and $(c) > (a)$.

Figure 4:
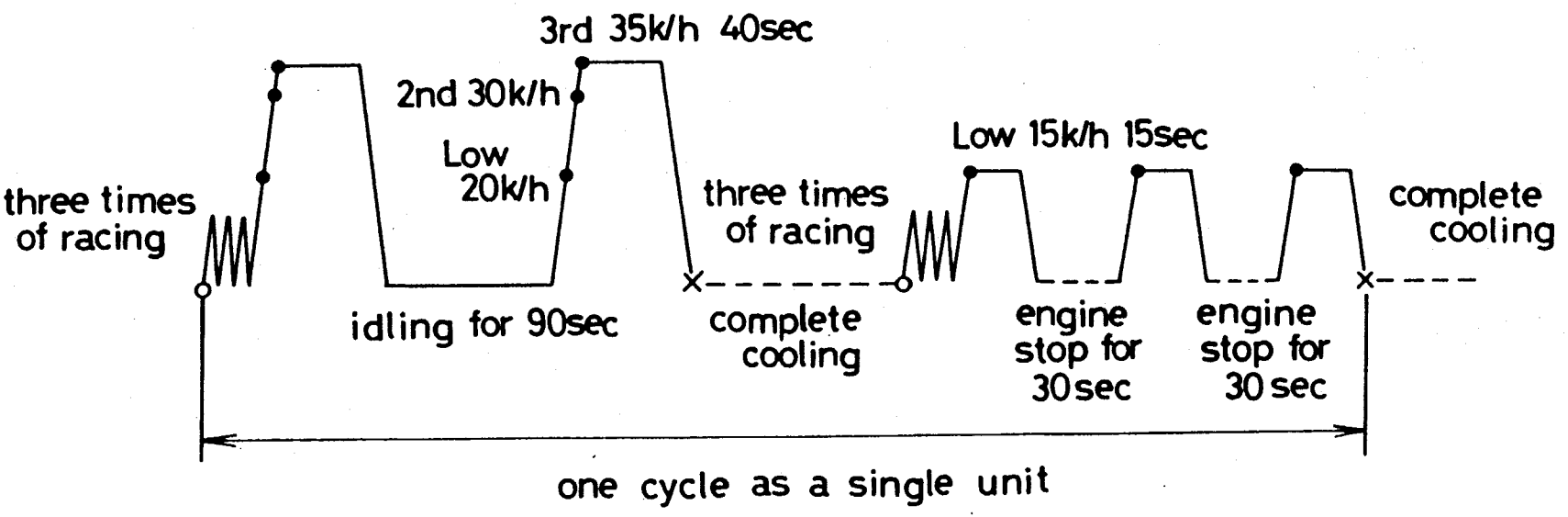
FIG. 4 is an explanatory graph obtained at the time of carrying out a pre-delivery test.
Figure 5:
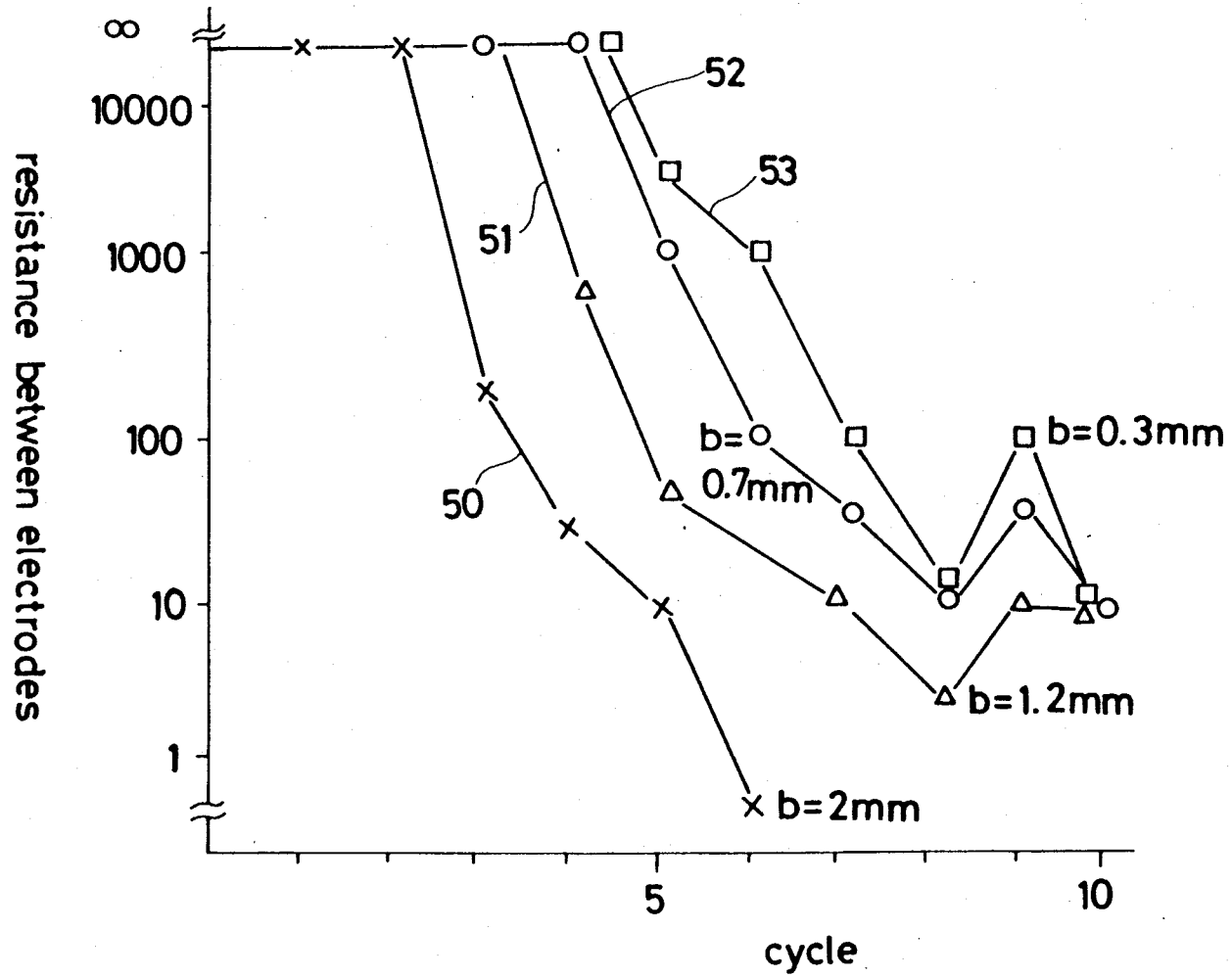
FIG. 5 is a graph showing results of the pre-delivery test.

Now, FIGS. 4 and 5 show results of a pre-delivery test carried out in connection with the spark plug (A).

Three spark plugs are prepared in which the vertical distance (b) is in turn measured to be 1.2 mm, 0.7 mm and 0.3 mm as results are found at numerals 51, 52 and 53 in FIG. 5. As a result is shown at numeral 50 in FIG. 5, a counterpart spark plug is prepared in which a vertical distance (b) is measured to be 2 mm, while an extended length (m) of a front end of the insulator is to be 1.5 mm.

These spark plugs are discretely secured to an internal combustion engine which is each operated ten cycles repeatedly in a manner as shown in FIG. 4 as a single cycle under a cold zone simulation in winter season.

The results obtained from the above test are as follows:

(i) It is found that the counterpart spark plug fails to restart the engine at six cycles. On the other hand, the spark plugs designated at the numerals 51, 52 and 53 in FIG. 5 enables to each discharge a spark through the spark gap (Gp) when the front end surface 23 of the insulator 2 is free from the carbon particle deposit. With the carbon deposit on the front end surface 23 of the insulator, the insulating resistance between the electrodes decreases to discharge a spark between the front end surface 23 and the inner surface 42 of the outer electrode, so that the carbon deposit is burned to be removed from the front end surface 23 so as to effect the self-cleaning action.

According to the invention, it is also found that the spark plugs enable the engine to restart at any stage of the operating cycle.

(ii) The front end of the leg portion 21 of the insulator 2 extends beyond that of the metallic shell 1 by 2.5 mm, so that the front end of the leg portion 21 is cooled more by an influence of an intake fuel gas mixture, and securing a heat-resistant property equivalent to that of a single-gap type spark plug.

(iii) According to an endurance test discretely carried out although not shown herein in detail, it is found that the spark plug of the invention shows 1.7 times as durable as a single-gap type spark plug in connection with a spark erosion resistance of a center electrode, and thus contributing to a long time period of servicing life.

Figure 6:
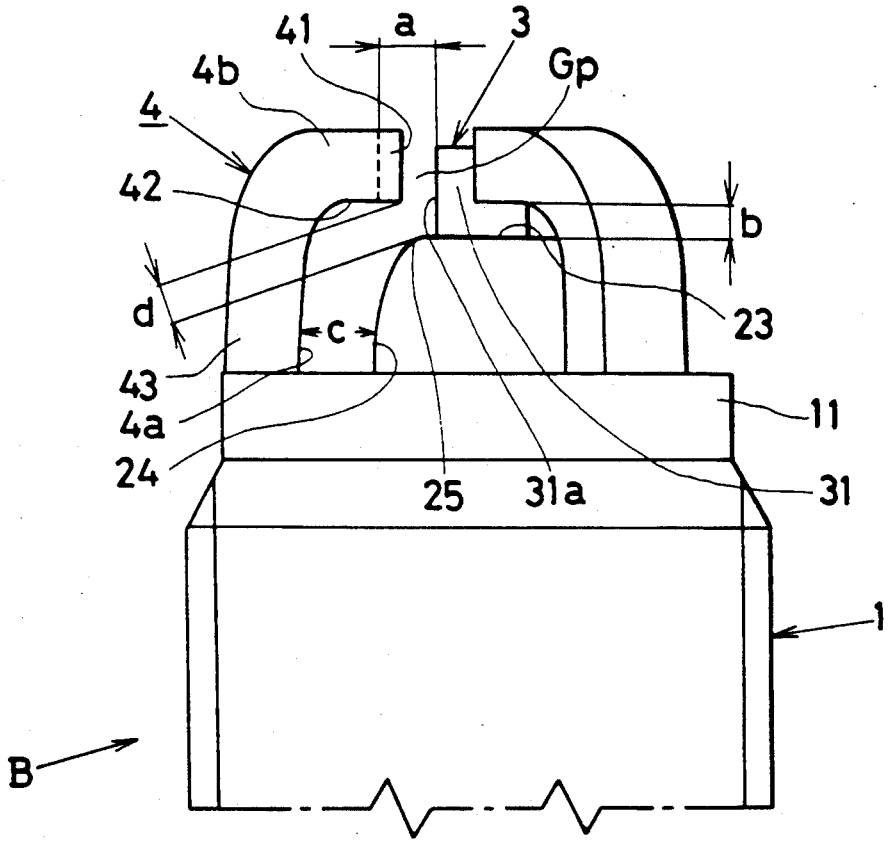
FIG. 6 is a view similar to FIG. 1 according to a second embodiment of the invention.

Referring to FIG. 6 which shows a spark plug (B) according to a second embodiment of the invention, the insulator 2 is somewhat reduced at its diametrical dimension for the purpose of realizing a compact spark plug as a whole.

In this second embodiment, like reference numerals in FIG. 1 are identical to those in FIG. 6. In the spark plug (B), the end tip 41 of the lateral piece **4*b* terminates somewhat short of the cornered portion 25 of the front end surface 23 of the leg portion 21**.

In this instance, as obvious by a manner of leading lines depicted in FIG. 6, a minimum distance (d) between the inner surface 42 of the lateral piece **4*b* of the outer electrode 4 and the front end surface 23 of the insulator 2**, is determined to be 0.7 mm by way of example.

On the other hand, the lateral shortest distance (c) between the outer surface 24 of the front end of the insulator 2 and the inner surface **4*a* of the vertical piece 43 of the outer electrode 4, is determined to be 1.5 mm. Further, the gap distance (a) between the outer surface 31*a* of the firing tip 31 and the end tip 41 of the lateral piece 4*b***, is determined to be 0.8 mm, a dimension of which is equivalent to the spark gap (Gp).

In this situation, the vertical distance (b) between the inner surface 42 of the lateral piece **4*b* of the outer electrode 4 and the front end surface 23 of the insulator 2** is determined to be approximately 0.7 mm (precisely 0.65 mm) so as to fall within a dimension ranging from 0.3 mm to 1.2 mm both inclusive.

As mentioned above, the vertical distance (b) is determined to be approximately 0.7 mm (precisely 0.65 mm) to fall within a dimension ranging from 0.3 mm to 1.2 mm both inclusive. In addition, the dimensional relationship among the distances (a), (d) and (c) is arranged to satisfy expressions of $(a/2) \leqq (d) \leqq (3a/2)$ and $(c) > (a)$.

It is noted that instead of 0.7 mm the distances (b), (d) are substantially freely arranged so long as these distances are within a dimension ranging from 0.3 mm to 1.2 mm both inclusive.

Further, it is appreciated that the invention is employed to not only triple-gap type spark plug but also dual-gap type spark plug.

It is noted that by calculating an arithmetical means from maximum and minimum distances, an average distance may be adopted instead of the lateral distance (c) in connection with a corresponding distance between an outer surface 24 of the front end of the insulator 2 and an inner surface **4*a* of the vertical piece 43 of the outer electrode 4**.

Furthermore, the material of the center electrode and the outer electrode is not confined only to nickel-based alloy. Carbide nitride and silicon nitride may be added to alumina when the insulator 2 is made.

It is further appreciated that the outer electrodes may be integrally depended from the front end of the metallic shell.

Various other modifications and changes may be also made without departing from the spirit and the scope of the following claims.

What is claimed is:

1. A multi-gap type spark plug for an internal combustion engine comprising:

a cylindrical metallic shell having a tubular ceramic insulator concentrically enclosed therein, said insulator having a tapered front leg portion whose front end extends beyond said metallic shell by 2.5 mm;

a center electrode concentrically enclosed in said insulator and having at a front end thereof a firing tip that extends beyond said insulator; and a plurality of L-shaped outer electrodes each having a vertical piece and a lateral piece, said vertical piece depending from said front end of said metallic shell to circumferentially surround said front end of said insulator, said lateral piece having an inner surface arranged in parallel with a front end surface of said insulator and an end tip terminated to oppose an outer surface of said firing tip establishing a spark gap therebetween;

wherein a vertical distance between said front end surface of said insulator and said inner surface of said lateral piece of each said outer electrode being within a range from 0.3 mm to 1.2 mm inclusive, and wherein said end tip of said lateral piece of each said outer electrode terminates short of a cornered portion of said front end surface of said insulator to partially overlap therewith, and a relationship among dimensions (a), (d) and (c) is determined as follows:

$$(a/2) \leqq d \leqq (3a/2),\ c > a$$

where (a): said spark gap between said outer surface of said firing tip and said end tip of said lateral piece of each said outer electrode, (d): a minimum distance between said front end surface of said insulator and said inner surface of said lateral piece of each said outer electrode, (c): a lateral distance between an outer surface of said front end of said insulator and an inner surface of said vertical piece of each said outer electrode.

2. In a multi-gap type spark plug for an internal combustion engine as recited in claim 1, wherein said leg portion of said insulator is 14 mm in length.

* * * * *